US005780962A

United States Patent [19]

Fujii et al.

[11] Patent Number: 5,780,962

[45] Date of Patent: Jul. 14, 1998

[54] COLOR SELECTION ELECTRODE MOUNTING STRUCTURE

[75] Inventors: Bunichiro Fujii; Kenichi Ozawa; Koji Saita, all of Kanagawa; Tsunenari Saito, Tokyo; Hajime Minegishi, Kanagawa, all of Japan

[73] Assignee: Sony Corporation, Tokyo, Japan

[21] Appl. No.: 683,212

[22] Filed: Jul. 18, 1996

[30] Foreign Application Priority Data

Jul. 20, 1995 [JP] Japan ..... 7-184508

[51] Int. Cl.[6] ..... H01J 29/07

[52] U.S. Cl. ..... 313/402; 313/404; 313/405; 313/407

[58] Field of Search ..... 313/402, 404, 313/405, 406, 407

[56] References Cited

U.S. PATENT DOCUMENTS

| | | | |
|---|---|---|---|
| 4,367,430 | 1/1983 | Matsushita et al. | 313/402 |
| 4,467,242 | 8/1984 | Wilbur et al. | 313/406 |
| 4,613,785 | 9/1986 | Ragland | 313/406 |
| 5,394,052 | 2/1995 | Oh | 313/405 |
| 5,610,474 | 3/1997 | Lagger et al. | 313/405 |

*Primary Examiner*—Sandra L. O'Shea
*Assistant Examiner*—Vip Patel
*Attorney, Agent, or Firm*—Hill & Simpson

[57] ABSTRACT

A color-selecting apparatus of a color display device which can effectively suppress vibration generated in a color-selecting electrode system, wherein one side of a supporting plate spring is fixed to a frame via a holder, and the other side of the supporting plate spring is fixed to the frame. The supporting plate spring is constituted by laminating flat plate springs, and the flat plate springs relatively move by deformation accompanying the vibration from the outside. The vibrational energy is consumed by the frictional energy generated between them.

12 Claims, 7 Drawing Sheets

COLOR SELECTION ELECTRODE MOUNTING STRUCTURE

BACKGROUND OF THE INVENTION

1. Field of the Invention

The present invention relates to a color display device, more particularly, a supporting apparatus for a color-selecting electrode system of a color display device which can effectively suppress the vibration of the color-selecting electrode system of the color display device.

2. Description of the Related Art

In a color television, for example, a slitted color-selecting electrode system attached to a frame is used for the color display device. When vibration is applied to this color-selecting electrode system, disturbances occur in the picture etc. and the color-selecting function cannot be adequately exhibited.

Accordingly, in color televisions in which the monitor and the speakers are integrally constituted and high resolution monitors, where vibration is apt to be occur in the color-selecting electrode system, measures against the vibration are particularly important.

As one such measure against vibration, there is known the method of increasing the tension of the electrodes of the slitted color-selecting electrode system (aperture grille). In this case, however, it is necessary to increase the strength of the frame so that a sufficient tension can be given and therefore the weight of the apparatus as a whole becomes large. For this reason, a means for reducing the vibration of the aperture grille without an increase of the weight of the overall apparatus has been desired.

SUMMARY OF THE INVENTION

An object of the present invention is to provide a supporting apparatus for a color-selecting electrode system of a color display device which makes the color-selecting unit resistant to vibration and, can effectively suppress the once generated vibration and a cathode ray tube incorporating the same.

According to a first aspect of the present invention, there is provided a cathode ray tube comprising: a fluorescent glass panel having a plurality of pins; a frame; a color selecting electrode system mounted on the frame; and a plurality of supporting members provided on the frame for fixing to the pins respectively, each of the supporting members having at least two thicknesses of first plate spring and second plate spring.

Preferably, one end of said first plate spring is fixed to the frame and the other end is fixed to one of the pins.

Also, preferably, one end of said second plate spring is fixed to the frame in conjunction with the first plate spring and the other end is movable relative to the first plate spring.

Preferably, one end of said second plate spring is fixed to one of the pins in conjunction with the first plate spring and the other end is movable relative to the first plate spring.

Preferably, the first plate spring has a triangular opening portion for being connected to one of the pins.

According to a second aspect of the present invention, there is provided a color selecting apparatus for cathode ray tube having a plurality of pins provided on a fluorescent glass panel, comprising: a frame; a color selecting electrode system mounted on the frame; and a plurality of supporting members provided on the frame for fixing to the pins respectively, each of supporting members having at least two thicknesses of first plate spring and second plate spring.

BRIEF DESCRIPTION OF THE DRAWINGS

These and other objects and features of the present invention will become clearer from the following description of the preferred embodiments made with reference to the appended drawings, in which.

DESCRIPTION OF THE PREFERRED EMBODIMENTS

Before explaining the preferred embodiments, a more detailed explanation of the related art will be given.

Figure 1:
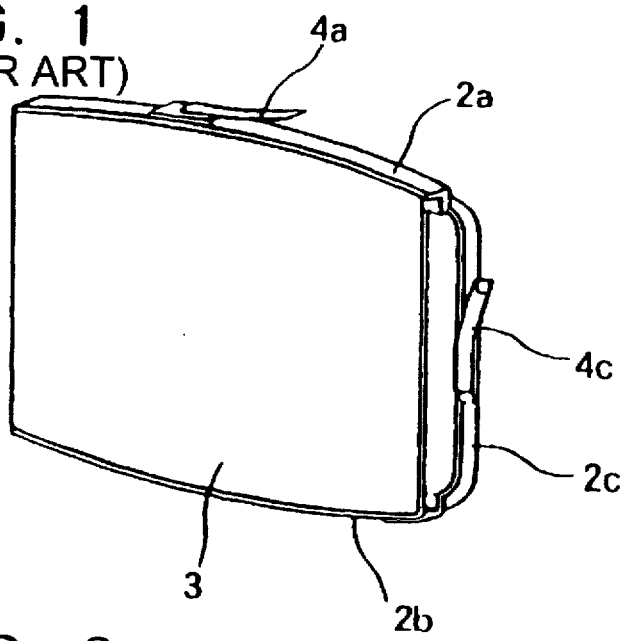
FIG. 1 (PRIOR ART)
FIG. 1 is a perspective view of the outer appearance of the supporting apparatus for a color-selecting electrode system of a color display device of the related art.
Figure 2:
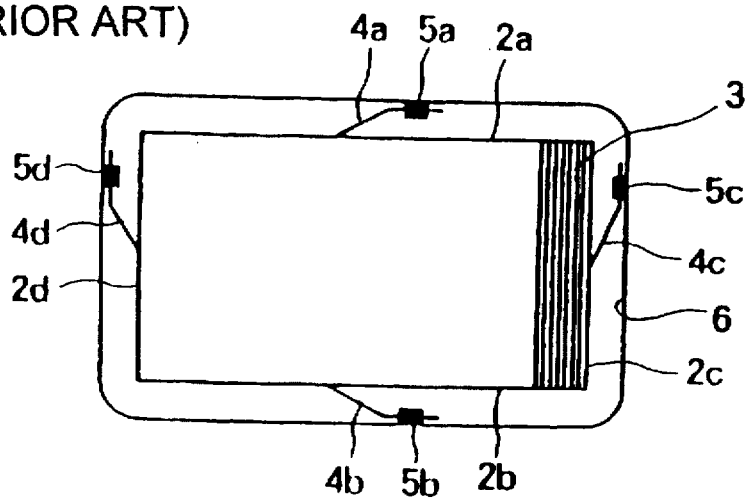
FIG. 2 (PRIOR ART)
FIG. 2 is a front view when a supporting apparatus for a color-selecting electrode system shown in FIG. 1 is mounted on the inner surface of a glass bulb.

FIG. 1 is a perspective view of an outer appearance of a supporting apparatus for a color-selecting electrode system of a color display device; FIG. 2 is a front view when the supporting apparatus for a color-selecting electrode system shown in FIG. 1 is mounted on an inner surface of a glass bulb; and FIGS. 3A and 3B are views illustrating the shape of a supporting plate spring.

As shown in FIG. 1 and FIG. 2, in the supporting apparatus for a color-selecting electrode system of a color display device, frames 2c and 2d are provided so as to connect frames 2a and 2b. An aperture grille 3 is tensed between the frames 2a and 2b at its two ends. At predetermined positions of the frames 2a, 2b, 2c, and 2d, supporting plate springs 4a, 4b, 4c, and 4d are affixed via not illustrated holders, respectively.

Figure 3A:
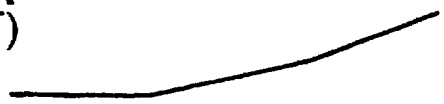
FIG. 3A (PRIOR ART)
FIGS. 3A and 3B are views for illustrating the shape of the supporting plate spring shown in FIG. 1.
Figure 3B:
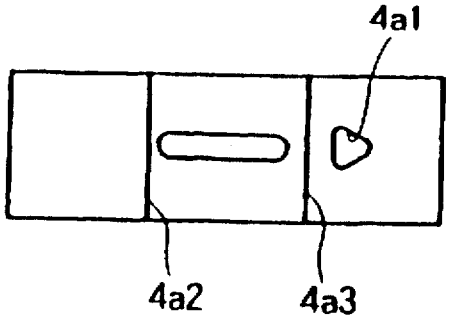
FIG. 3B (PRIOR ART)

FIGS. 3A and 3B are views illustrating the supporting plate spring 4a, in which FIG. 3A is a side view and FIG. 3B is a front view.

The supporting plate spring 4a comprises a single flat plate spring as shown in FIG. 3A. As shown in FIG. 3B, an opening portion 4a1 having a substantially triangular shape is provided. Further, the supporting plate spring 4a is bent into two levels at the bent line portions 4a2 and 4a3.

The supporting plate springs 4b, 4c, and 4d have substantially the same shape as that of the supporting plate spring 4a.

Figure 4:
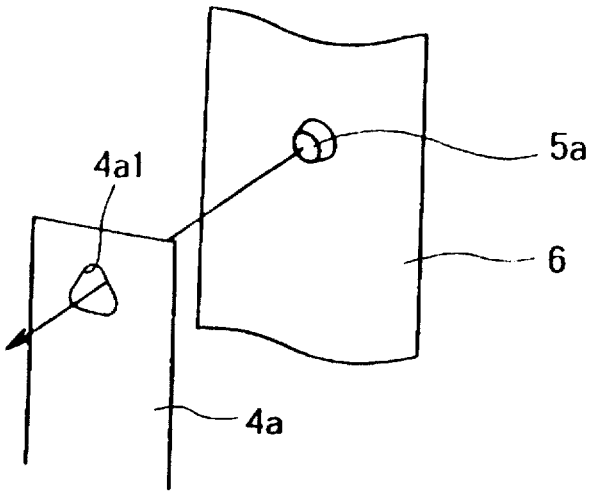
FIG. 4 (PRIOR ART)
FIG. 4 is a view for explaining the aspect where the supporting plate spring is mounted on a pin on the inner surface of the glass bulb.

The opening portions 4a1 etc. of the supporting plate springs 4a to 4d are respectively fitted over the pins 5a to 5d provided on the inner surface 6 of the glass bulb as shown in FIG. 2 and FIG. 4 to affix the same.

In the supporting apparatus for a color-selecting electrode system of the color display device of the related art mentioned above, however, the supporting plate springs 4a to 4d have a very low rigidity in comparison with the frames 2a to 2d, therefore when vibration is applied to the entire cathode ray tube, the supporting plate springs 4a to 4d vibrate by larger degrees in comparison with the frames 2a to 2d and a large elastic force is generated due to the deformation by the vibration. As a result, the vibration of the supporting plate springs 4a to 4d transferred to the frames 2a to 2d also causes the aperture grille 3 to vibrate.

At this time, in the supporting apparatus for a color-selecting electrode system of the color display device of the related art, since use is made of a device where the supporting plate springs 4a to 4d are constituted by a single flat plate spring, there is only the characteristic of a simple spring and there is almost no effect of attenuating the vibration of the frames 2a to 2d. As a result, there is a problem in that the vibration of the aperture grille 3 continues for a long time and that along with this the disturbance of the picture continues for a long time.

Next, an explanation will be made of a supporting apparatus for a color-selecting electrode system of a color display device according to an embodiment of the present invention and a cathode ray tube incorporating the same.

Figure 5:
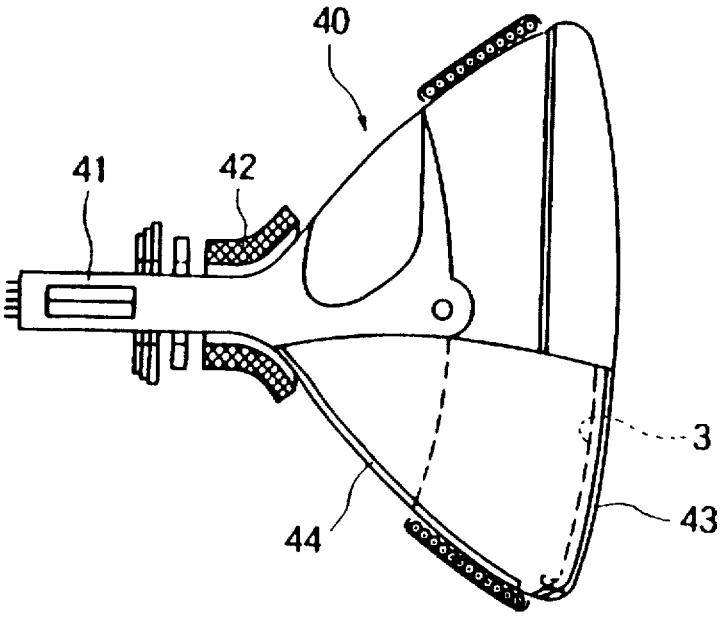
FIG. 5 is a view for illustrating a cathode ray tube.
Figure 6:
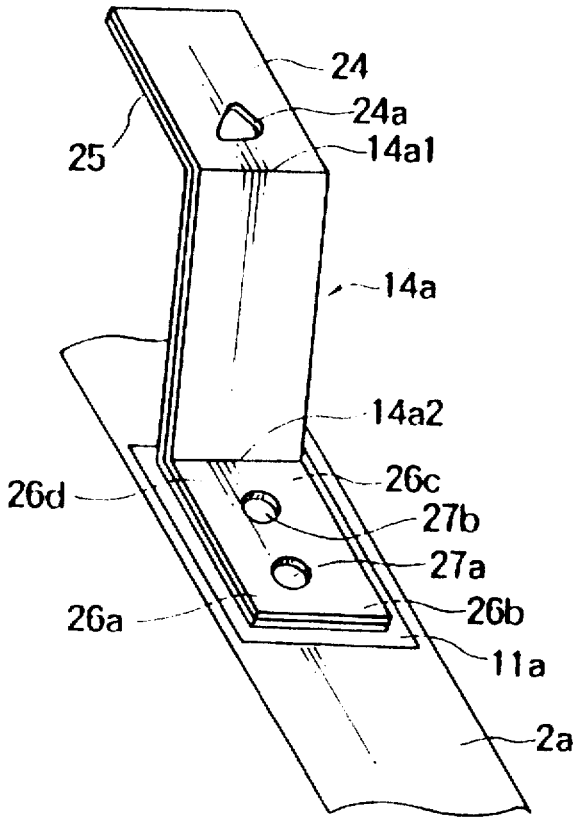
FIG. 6 is a perspective view of an outer appearance of a supporting plate spring used in a supporting apparatus for a color-selecting electrode system of a color display device according to an embodiment of the present invention.
Figure 7:
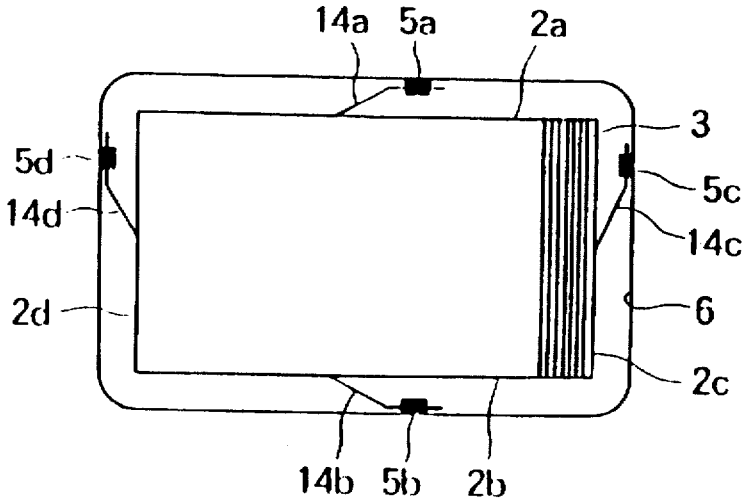
FIG. 7 is a view for explaining the supporting apparatus for a color-selecting electrode system of the color display device according to the embodiment of the present invention.

FIG. 6 is a perspective view of the outer appearance of the supporting plate spring used in the supporting apparatus for a color-selecting electrode system of the color display device according to the present embodiment; FIG. 7 is a view for explaining the supporting apparatus for a color-selecting electrode system of a color display device according to the present embodiment; FIGS. 8A to 8D are views for explaining the supporting plate spring shown in FIG. 6; and FIG. 5 is a view for explaining a cathode ray tube.

The supporting apparatus for a color-selecting electrode system of a color display device according to the present embodiment is used in a cathode ray tube 40 shown in FIG. 5. The cathode ray tube 40 is constituted by sealing an electron gun 41 and a phosphor screen 43 inside a glass bulb 44. The aperture grille 3 is provided on the front surface of the phosphor screen 43. Electrons from the electron gun 41 are deflected by a deflection yoke 42 and emitted to a predetermined position on the phosphor screen 43.

In the supporting apparatus for a color-selecting electrode system of a color display device according to the present embodiment, as shown in FIG. 7, frames 2c and 2d are provided so as to connect the frames 2a and 2b, and the aperture grille 3 is tensed between the frames 2a and 2b at its two ends. At predetermined positions of the frames 2a, 2b, 2c, and 2d, as shown in FIG. 6, supporting plate springs 14a, 14b, 14c, and 14d are respectively fixed via a holder 11a etc. The holder 11a etc. play the role of correcting the effects of changes in temperature of the frames 2a to 2d and the supporting plate springs 14a to 14d.

Below, a detailed explanation will be made of the supporting plate spring 14a.

Figure 8A:
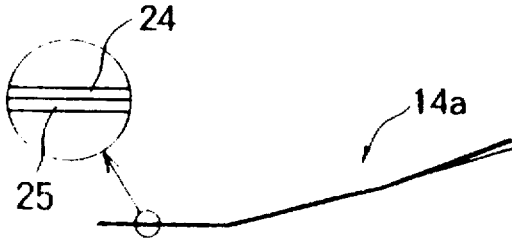
FIGS. 8A to 8D are views illustrating a supporting plate spring shown in FIG. 6.
Figure 8B:
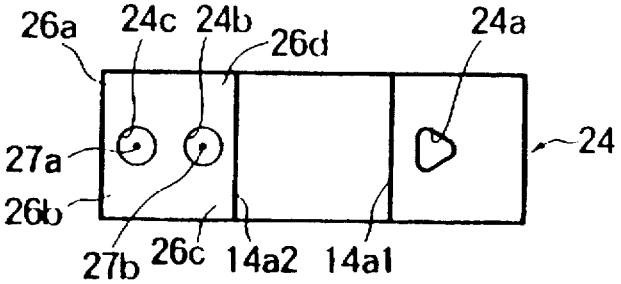
Figure 8C:
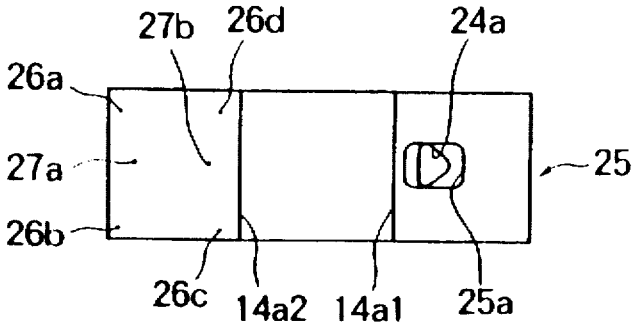
Figure 8D:
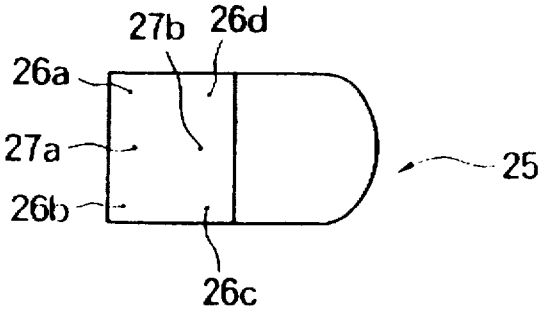

FIG. 8A is a side view; FIG. 8B is a front view; FIG. 8C is a back view; and FIG. 8D is a view explaining another shape of the plate spring 25.

As shown in FIG. 6 and FIG. 8A, the supporting plate spring 14a is constituted by using laminated plate springs formed by laminating the flat plate springs 24 and 25 and is bent into two levels at the bent line portions 14a1 and 14a2. At this time, it is also possible to constitute the flat plate spring 24 and the flat plate spring 25 by using the same material or constitute the same by using different materials.

In the flat plate spring 24, as shown in FIG. 8B, an opening portion 24a having a substantially triangular shape in which the pin 5a shown in FIG. 7 fits and opening portions 24b and 24c having substantially circular shapes are formed.

By forming the opening portion 24a in a substantially triangular shape in this way, the supporting plate spring 14a can be mounted over the pin 5a in a stable state.

In the flat plate spring 25, as shown in FIG. 8C, an opening portion 25a larger than the opening portion 24a is formed at a position corresponding to the opening portion 24a of the flat plate spring 24. The flat plate spring 25 is joined to the frame 2a via the holder 11a by for example welding at the positions indicated by 27a and 27b in the figure. At this time, welds are made at the positions 27a and 27b of the flat plate spring 25 via the opening portions 24b and 24c formed in the flat plate spring 24. By doing this, in comparison with a case where the flat plate springs 24 and 25, the holder 11a, and the frame 2a are welded together, the energy necessary for welding can be made lower.

The flat plate spring 24 and the flat plate spring 25 are joined at the four points indicated by 26a to 25d in the figure by for example welding.

Figure 9:
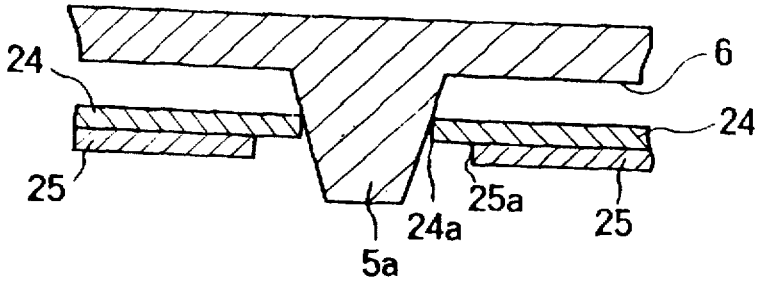
FIG. 9 is a side view illustrating a relationship between the supporting plate spring shown in FIG. 6 and a pin provided on an inner surface of a glass bulb.

The opening portion 24a of the flat plate spring 24 and the opening portion 25a of the flat plate spring 25 are mounted over the pin 5a provided on the inner surface 6 of the glass bulb as shown in FIG. 9. Namely, the pin 5a is fitted in the opening portion 24a of the flat plate spring 24 in a close contact state. The pin 5a penetrates through the opening portion 25a of the flat plate spring 25 with a certain amount of room. Accordingly, in the state where the supporting plate spring 14a is mounted over the pin 5a, the flat plate spring 24 is fixed in place, but the flat plate spring 25 becomes moveable with respect to the flat plate spring 24. Accordingly, as will be mentioned later, when a load due to vibration is applied to the supporting plate spring 14a, the flat plate springs 24 and 25 move relative to each other and friction is generated on the contact surfaces of the flat plate springs 24 and 25.

The structures of the supporting plate springs 14b, 14c, and 14d are basically the same as that of the supporting plate spring 14a.

Next, an explanation will be made of the mode of operation of the supporting plate spring 14a in a case where vibration is applied to the inner surface 6 of the glass bulb and the frames 2*a* to 2*d*.

For example, when vibration is applied from outside to the inner surface 6 of the glass bulb and the frames 2*a* to 2*d*, the load caused by this vibration is applied to the supporting plate springs 14*a* to 14*d*, and the supporting plate springs 14*a* to 14*d* displace. Then, due to the displacement of these supporting plate springs 14*a* to 14*d*, the flat plate spring 24 and the flat plate spring 25 move relative to each other against the friction force of their contact surfaces, the vibration energy is consumed as the frictional energy, and the vibration is attenuated.

Figure 10:
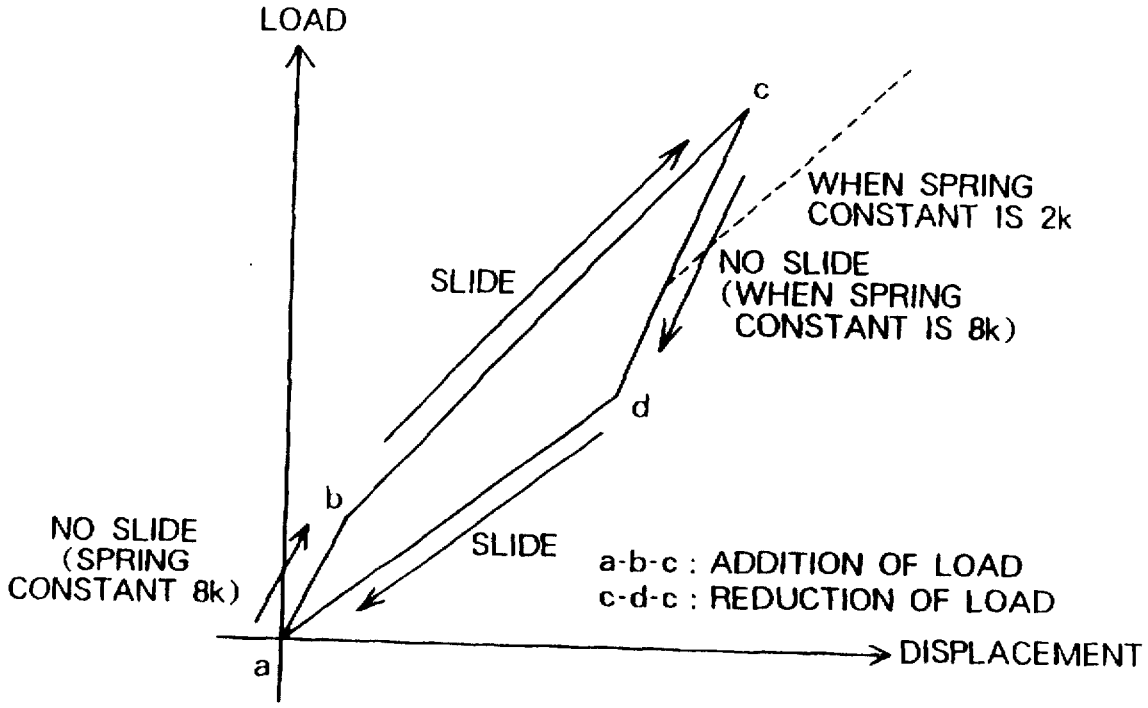
FIG. 10 is a view showing a relationship between a load applied to the supporting plate spring shown in FIG. 6 and a displacement thereof.

FIG. 10 is a graph showing a relationship between the load applied to the supporting plate spring 14*a* and the displacement.

In the supporting plate spring 14*a*, when the load is applied and it displaces, friction is generated between the flat plate springs 24 and 25 due to that displacement and the vibration energy is consumed as the frictional energy. Therefore the curve showing the relationship between the load and displacement of the supporting plate spring 14*a* becomes a hysteresis loop as shown in FIG. 10.

At this time, the surface area of the portion surrounded by the curve shown in FIG. 10 indicates the energy consumed by the displacement of one cycle of vibration.

In the load-displacement the state an FIG. 10, at the state "a" where the displacement is "0", the supporting plate spring 14*a* is in a static friction state where no sliding occurs. The spring constant at this time has become for example 8*k*. Here, k is the spring constant of the single flat plate springs 24 and 25. Thereafter, when the load rises to a certain value, the flat plate spring 25 moves relative to the flat plate spring 24, and the supporting plate spring 14*a* enters into a dynamic friction state. In this dynamic friction state, the supporting plate spring 14*a* becomes hard to deform by the friction generated between the flat plate springs 24 and 25, and therefore the spring constant becomes $2k+\alpha(6k>\alpha>0)$ obtained by adding the spring constant $\alpha$ of the amount of friction to the sum of the spring constants of the flat plate springs 24 and 25. Next, when the load is reduced, the deformation of the supporting plate spring 14*a* temporarily stops, the dynamic friction state once again changes to the static friction state, and the spring constant becomes 8*k*. Thereafter, the deformation of the supporting plate spring 14*a* progresses. When the internal stress becomes high, it enters becomes the dynamic friction state again. The friction between the flat plate springs 24 and 25 acts as a resistance with respect to the supporting plate spring 14*a* which tries to return to the original posture, and the spring constant becomes $2k-\alpha(6k>\alpha>0)$.

Figure 11:
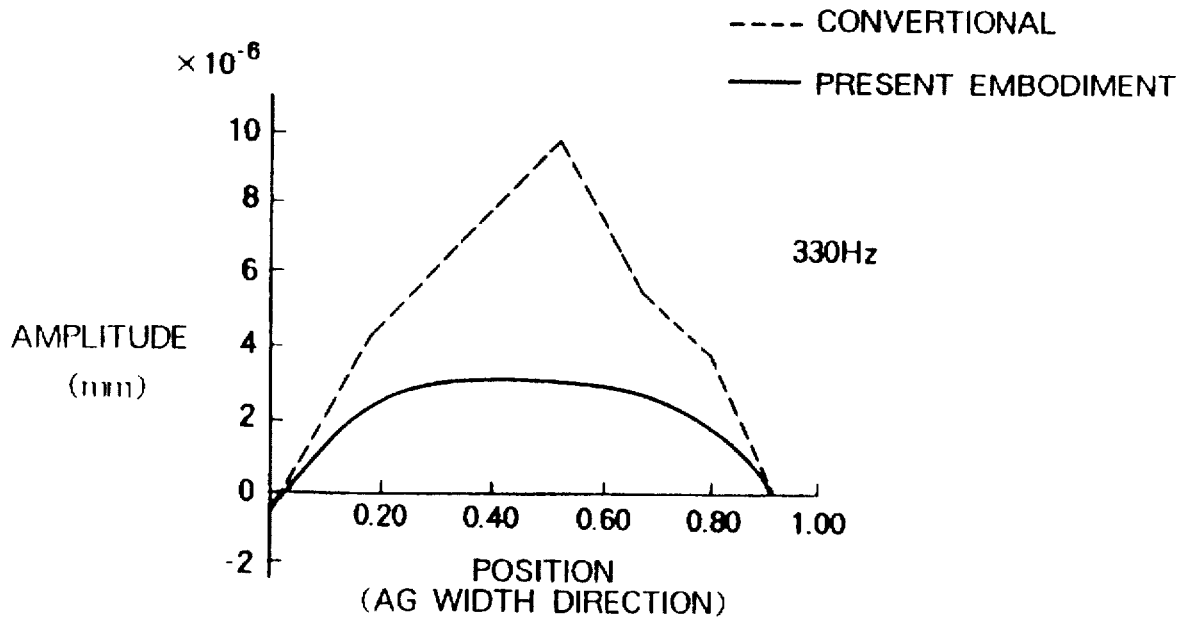
FIG. 11 is a view illustrating a vibration characteristic of an aperture grille in a case where a supporting plate spring made using laminated plate springs shown in FIG. 6 is used and a case where a supporting plate spring made using a single plate spring shown in FIG. 1 is used in the case where a vibration of a frequency of 330 Hz is applied.
Figure 12:
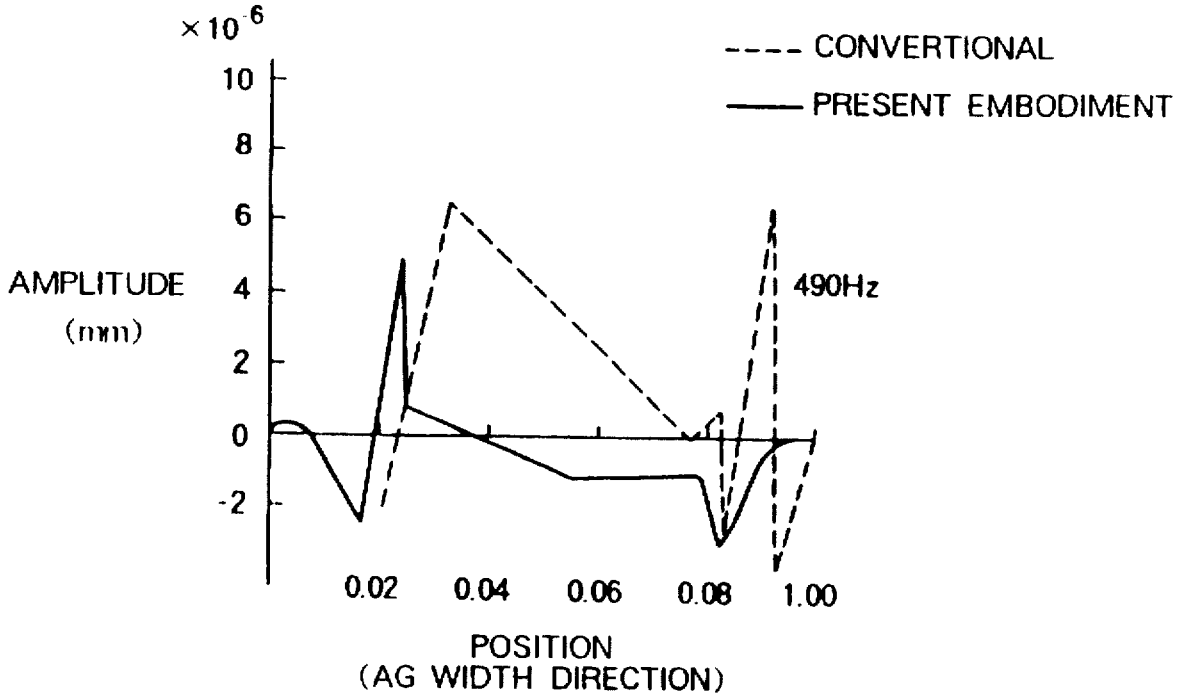
FIG. 12 is a view illustrating a vibration characteristic of an aperture grille in a case where a supporting plate spring made using laminated plate springs shown in FIG. 6 is used and a case where a supporting plate spring made using a single plate spring shown in FIG. 1 is used in the case where a vibration of a frequency of 490 Hz is applied.

FIG. 11 is a view for explaining a vibration characteristic of an aperture grille in a case where a supporting plate spring made using laminated plate springs shown in FIG. 6 is used and a case where a supporting plate spring made using a single plate spring shown in FIG. 1 is used in the case where a vibration of a frequency of 330 Hz is applied. FIG. 12 is a similar view in the case where a vibration of a frequency of 490 Hz is applied.

In FIGS. 11 and 12, the abscissa indicates the position of the aperture grille 3 in the width direction, and the ordinate indicates the amplitude.

As shown in FIGS. 11 and 12, in both cases where vibration of the frequency of 330 Hz and the frequency of 490 Hz is applied, at most positions of the aperture grille 3, the amplitude of the vibration of the aperture grille 3 has become low in the case where the supporting plate spring 14*a* is used in comparison with the case where the supporting plate spring 4*a* is used.

Namely, according to a color-selecting apparatus of the present embodiment, by using the laminated plate springs as the supporting plate springs 14*a* to 14*d*, even in a case where vibration is applied to the frames 2*a* to 2*d* from the outside, the aperture grille 3 is made resistant to vibration and, at the same time, the vibrational energy which is once generated can be effectively attenuated by the frictional force between the plate springs 24 and 25.

For this reason, even in a case where vibration is applied from the outside, almost no vibration is generated in the aperture grille 3. Also, vibration which is once generated is attenuated in a short time. Therefore the color selecting function of the aperture grille 3 is stably exhibited, and a high grade picture can be provided.

The present invention is not limited to the above embodiment. For example, in the above embodiment, a spring obtained by laminating two plate springs 24 and 25 was illustrated as the supporting plate spring 14*a*, but also a structure in which three or more plate springs are laminated can be adopted. Further, in the above embodiment, plate springs 24 and 25 having a substantially equal size were illustrated, but it is also possible to adopt a structure in which a plate spring 25 having a surface area smaller than that of the plate spring 24 is used as shown in FIG. 8D, and friction is generated only in the portion where part of the back surface of the plate spring 24 contacts the plate spring 25.

Further, in the above embodiment, a structure was illustrated in which the side of the supporting plate spring to be joined to the frame was fixed and the flat plate springs 24 and 25 were made able to relatively move at the side to be joined to the inner surface of the glass bulb, but a similar effect can be obtained in the present invention even if a structure is adopted in which the side of the supporting plate spring to be joined to the inner surface of the glass bulb is fixed and the flat plate springs 24 and 25 can relatively move at the side to be joined to the frame.

Figure 13:
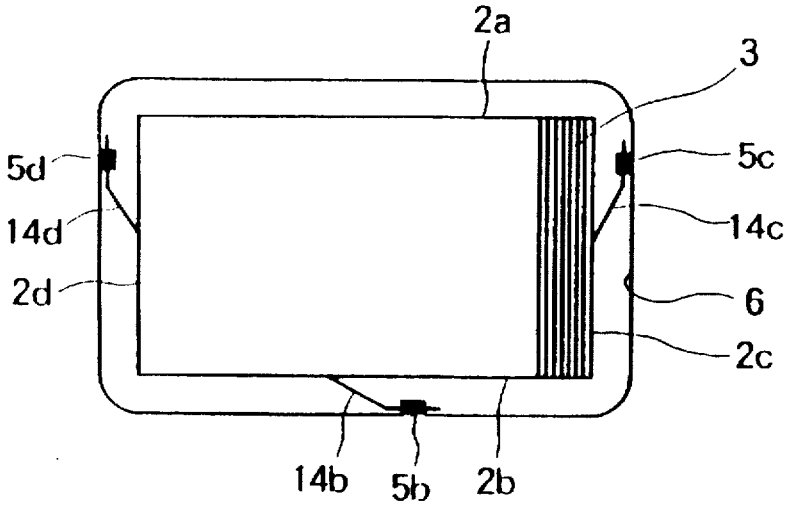
FIG. 13 is a view showing another example of the supporting apparatus for a color-selecting electrode system of the color display device according to the embodiment of the present invention.

Further, in the above embodiment, a case of using four supporting plate springs 14*a* to 14*d* as shown in FIG. 6 was exemplified, but it is also possible to adopt a structure using three supporting plate springs 14*b*, 14*c*, and 14*d* as shown in FIG. 13.

As explained above, according to the supporting apparatus for a color-selecting electrode system of the color display device of the present invention and the cathode ray tube incorporating the same, since laminated plate springs are used as an engagement means, even in a case where vibration is applied to the frame from the outside, the color-selecting electrode system is made resistant to vibration and the vibrational energy which is once generated can be effectively attenuated by the frictional force between the plurality of plate springs. As a result, according to the supporting apparatus for a color-selecting electrode system of the color display device of the present invention and the cathode ray tube incorporating the same, the function of the color-selecting electrode system can be stably and adequately exhibited, and a high grade picture can be stably obtained.

What is claimed is:

1. A cathode ray tube comprising:

a fluorescent glass panel;

a plurality of pins provided on a surface of said fluorescent glass panel;

a frame member;

a color selection electrode system supported by said frame member; and a plurality of supporting members, each supporting member having a first end fixed to a portion of said frame member and a second end fixed by a first of said plurality of pins to support said frame member and said color selection electrode system to said surface of said fluorescent glass panel, each of said plurality of supporting members comprising a first plate spring member and a second plate spring member having an outer shape substantially equal to an outer shape of said first plate spring member, said first plate spring member and said second plate spring member having predetermined spring characteristics for supporting said color selection electrode system to said surface of said fluorescent glass panel at a predetermined spring force, said first plate spring member having a first opening into which said first pin is fittingly inserted, said second plate spring member having a second opening larger than said first opening, into which said first pin is inserted, said first end of each supporting member comprising first ends of both said first and second plate spring members, said first pin fittingly inserted into said first opening of said first spring member and inserted into said second opening of said second spring member at second ends of both said first and second plate spring members.

2. A cathode ray tube as claimed in claim 1, further comprising:

an engageable inner edge of said second opening of said second plate spring member, said inner edge engaged by said first pin when a predetermined large movement force parallel to a surface of said second end of said second plate spring member is applied.

3. A cathode ray tube as claimed in claim 2, further comprising:

a middle portion disposed between said first end and said second end of each of said support members wherein said first end is parallel to, yet not linear with, said second end.

4. A cathode ray tube as claimed in claim 1, further comprising:

a holder for securing said first ends of both said first and second plate spring members to said frame member.

5. A cathode ray tube as claimed in claim 4, further comprising:

at least one hole at said first end of said first plate spring and at least one hole at said first end of said second plate spring to facilitate affixation of said first and second plate springs to said frame member with said holder.

6. A cathode ray tube as claimed in claim 1, wherein said first plate spring has a triangular opening for connection to one of the plurality of pins.

7. A color selecting apparatus for a cathode ray tube including a fluorescent glass panel having a plurality of pins, comprising:

a frame member;

a color section electrode system supported by said frame member; and a plurality of supporting members, each supporting member having a first end fixed to a portion of said frame member and a second end fixed by a first of said plurality of pins to support said frame member and said color selection electrode system to said surface of said fluorescent glass panel, each of said plurality of supporting members comprising a first plate spring member and a second plate spring member having an outer shape substantially equal to an outer shape of said first plate spring member, said first plate spring member and said second plate spring member having predetermined spring characteristics for supporting said color selection electrode system to said surface of said fluorescent glass panel at a predetermined spring force, said first plate spring member having a first opening into which said first pin is fittingly inserted, said second plate spring member having a second opening larger than said first opening, into which said first pin is inserted, said first end of each supporting member comprising first ends of both said first and second plate spring members, said first pin fittingly inserted into said first opening of said first spring member and inserted into said second opening of said second spring member at second ends of both said first and second plate spring members.

8. A color selecting apparatus as claimed in claim 7, further comprising:

an engageable inner edge of said second opening of said second plate spring member, said inner edge engaged by said first pin when a predetermined large movement force parallel to a surface of said second end of said second plate spring member is applied.

9. A color selecting apparatus as claimed in claim 8, further comprising:

a middle portion disposed between said first end and said second end of each of said support members wherein said first end is parallel to, yet not linear with, said second end.

10. A color selecting apparatus as claimed in claim 7, further comprising:

a holder for securing said first ends of both said first and second plate spring members to said frame member.

11. A color selecting apparatus as claimed in claim 10, further comprising:

at least one hole at said first end of said first plate spring and at least one hole at said first end of said second plate spring to facilitate affixation of said first and second plate springs to said frame member with said holder.

12. A color selecting apparatus as claimed in claim 11, wherein said first plate spring has a triangular opening for connection to one of the plurality of pins.

* * * * *